United States Patent [19]

Kawasaki

[11] 4,407,214

[45] Oct. 4, 1983

[54] NON-ROLL TUG-AND-BARGE LINKAGE

[76] Inventor: Masasuke Kawasaki, 1002 Michigan Ave., Slidell, La. 70458

[21] Appl. No.: 218,052

[22] Filed: Dec. 19, 1980

Related U.S. Application Data

[63] Continuation-in-part of Ser. No. 138,642, Apr. 8, 1980, abandoned.

[51] Int. Cl.[3] ..... B63B 21/00

[52] U.S. Cl. ..... 114/249; 114/242; 114/77 R

[58] Field of Search ..... 114/77, 242, 248-251

[56] References Cited

U.S. PATENT DOCUMENTS

| | | | |
|---|---|---|---|
| 7,374 | 10/1876 | Raymond et al. . | |
| 20,944 | 7/1858 | Gibson . | |
| 45,720 | 1/1865 | Ingalls . | |
| 1,038,676 | 9/1912 | Stevens . | |
| 1,458,134 | 6/1923 | Constan . | |
| 2,431,039 | 11/1947 | Harrison | 114/235 |
| 2,722,907 | 11/1955 | Dyer | 114/235 |
| 2,984,202 | 5/1961 | Lunde | 114/235 |
| 3,035,536 | 5/1962 | Archer | 114/77 |
| 3,062,170 | 11/1962 | Verneaux | 114/235 |
| 3,125,059 | 3/1964 | Verneaux et al. | 114/235 |
| 3,257,985 | 6/1966 | Glosten | 114/235 |
| 3,257,986 | 6/1966 | Glosten | 114/235 |
| 3,345,970 | 10/1967 | DeLong | 114/235 |
| 3,353,512 | 11/1967 | Mathews et al. | 114/235 |
| 3,461,829 | 8/1969 | Musvold | 114/249 |
| 3,512,495 | 5/1970 | Fletcher | 114/235 |
| 3,568,621 | 3/1971 | Kawasaki | 114/235 |
| 3,645,225 | 2/1972 | Lunde | 114/235 |
| 3,651,778 | 5/1972 | Derector | 114/235 |
| 3,726,248 | 4/1973 | Glosten | 114/235 |
| 3,735,722 | 5/1973 | Hooper et al. | 114/235 |
| 3,756,183 | 9/1973 | Clemence, Jr. | 114/235 |
| 3,892,195 | 7/1975 | Janssen | 114/235 |

FOREIGN PATENT DOCUMENTS

| | | | |
|---|---|---|---|
| 1100495 | 2/1961 | Fed. Rep. of Germany | 114/77 R |
| 1297491 | 9/1962 | France . | |
| 2144374 | 6/1972 | France . | |
| 2268969 | 4/1975 | France . | |
| 194923 | 3/1965 | Sweden . | |
| 125931 | 7/1919 | United Kingdom | 114/235 |
| 1207341 | 9/1970 | United Kingdom . | |
| 1207342 | 9/1970 | United Kingdom . | |
| 610715 | 8/1976 | U.S.S.R. . | |

*Primary Examiner*—Trygve M. Blix
*Assistant Examiner*—Stephen P. Avila
*Attorney, Agent, or Firm*—Arnold, White & Durkee

[57] ABSTRACT

An apparatus is disclosed for coupling first and second vessels wherein the apparatus minimizes roll of one vessel relative to the other while permitting freedom of movement for pitching and heaving of one vessel relative to the other. The apparatus comprises a linkage frame pivotally secured to one end of the first vessel along a substantially horizontal axis. The frame defines a recess generally facing the second vessel and having inner elongated opposing surfaces. Outer opposing surfaces are included, typically mounted on the second vessel, for aligning one end of the second vessel between the inner opposing surfaces of the linkage frame such that roll of the second vessel is minimized relative to the first vessel. Additionally, a connector for securing the second vessel to the linkage frame may be included, the connector being such that freedom of movement of the second vessel relative to the first vessel for pitching and heaving is permitted.

46 Claims, 25 Drawing Figures

FIG. 1
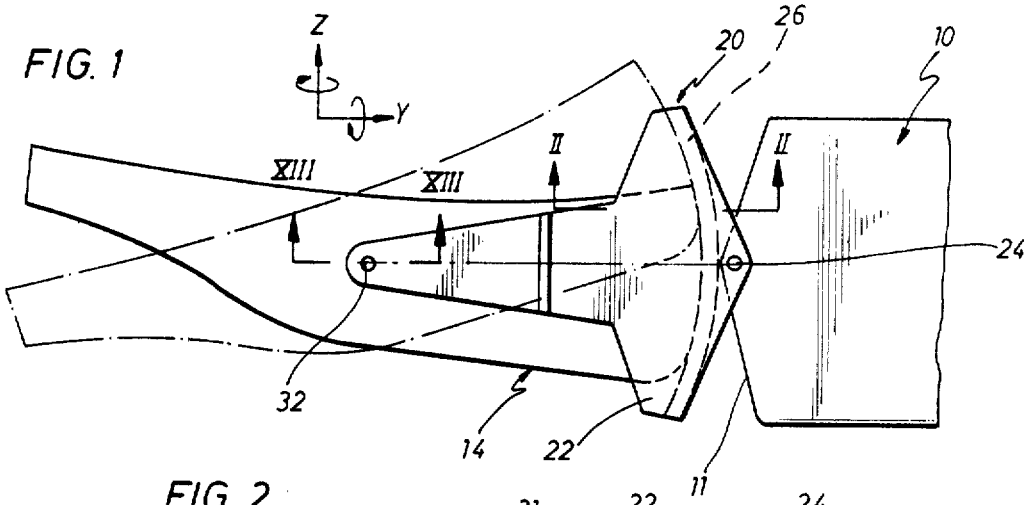
FIG. 2
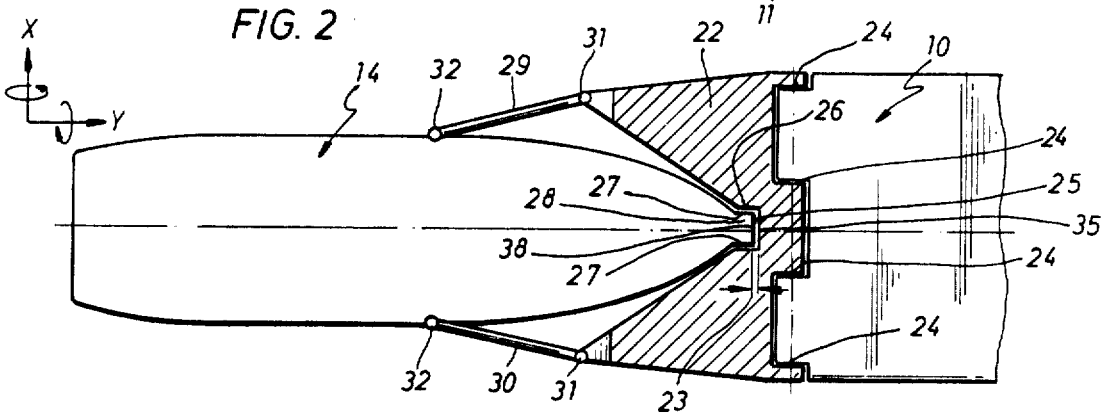
FIG. 4
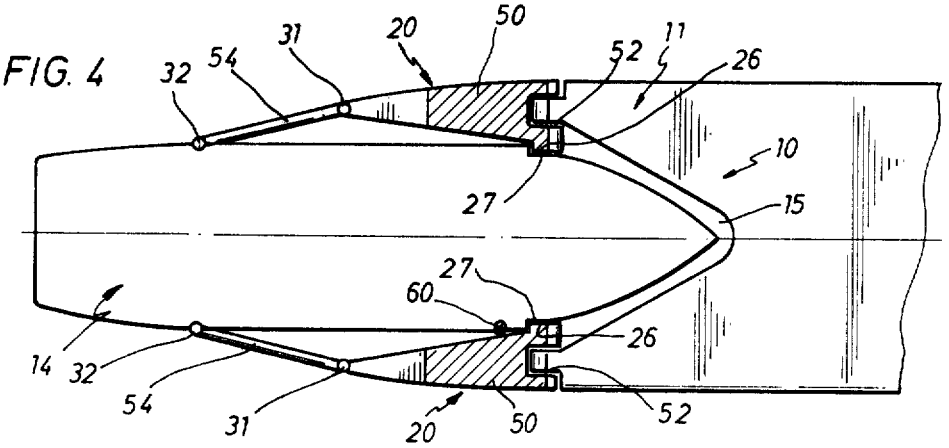
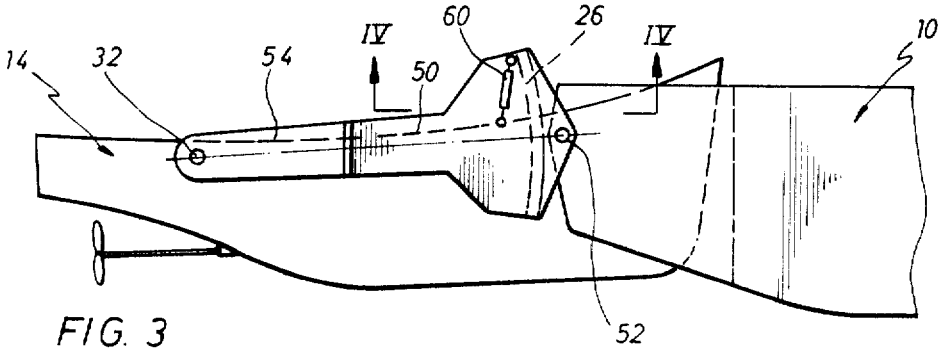
FIG. 3

FIG 18
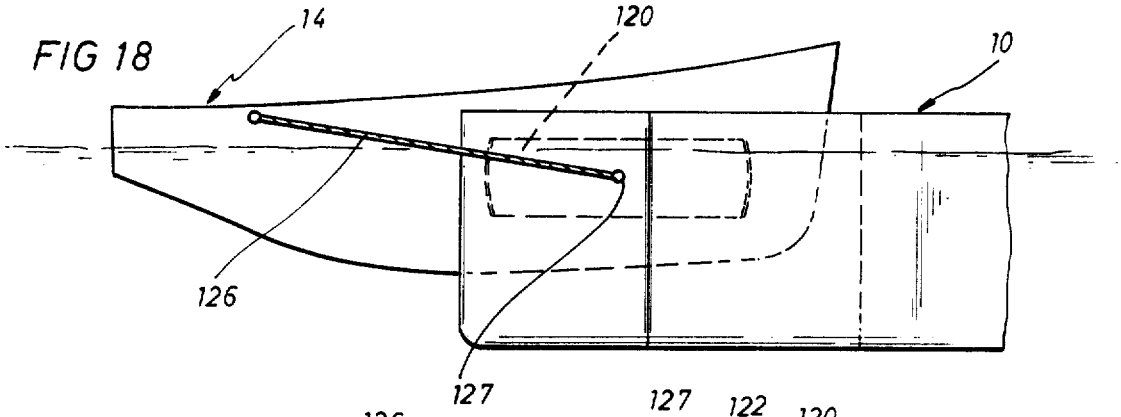
FIG. 19
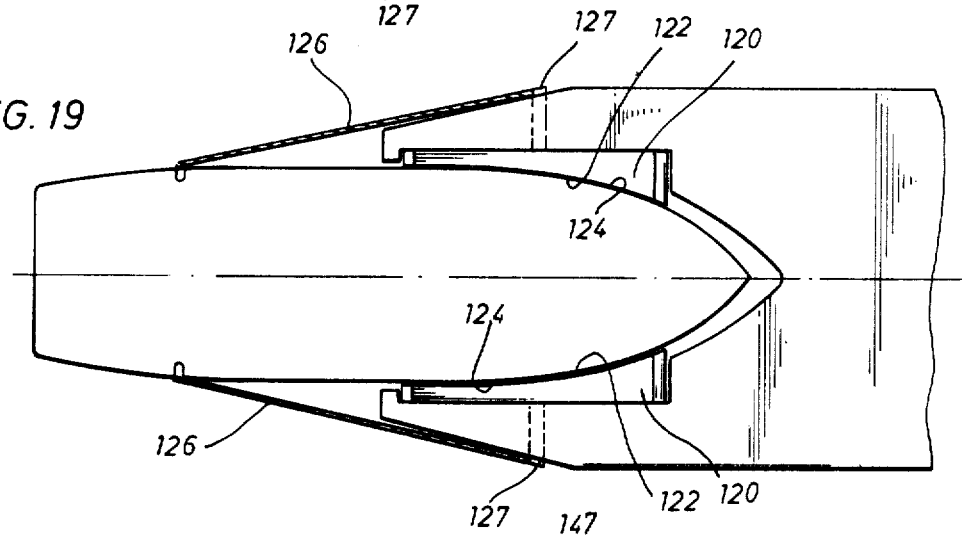
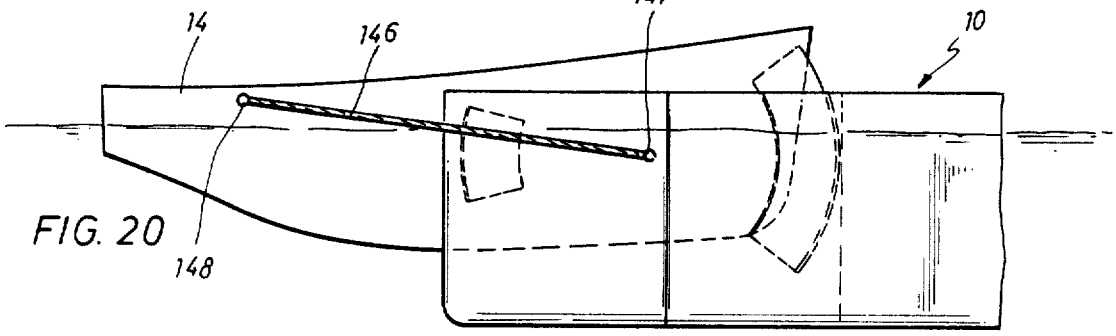
FIG. 20
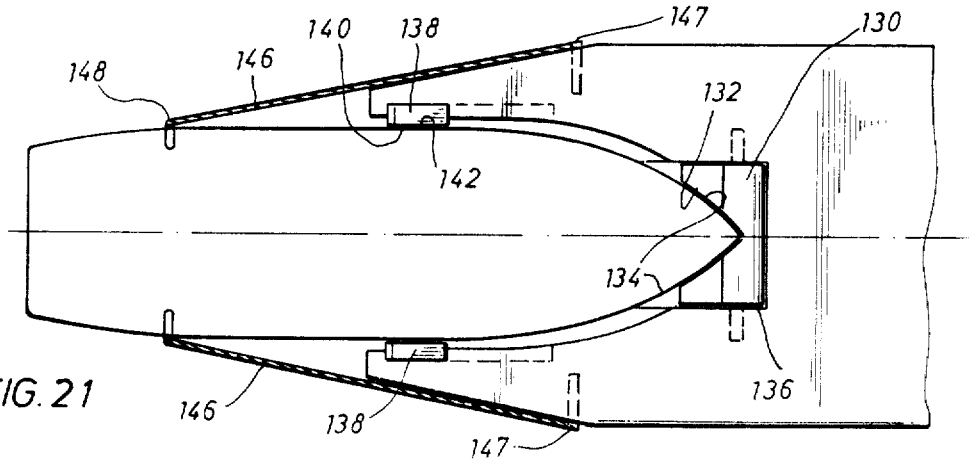
FIG. 21

FIG. 22
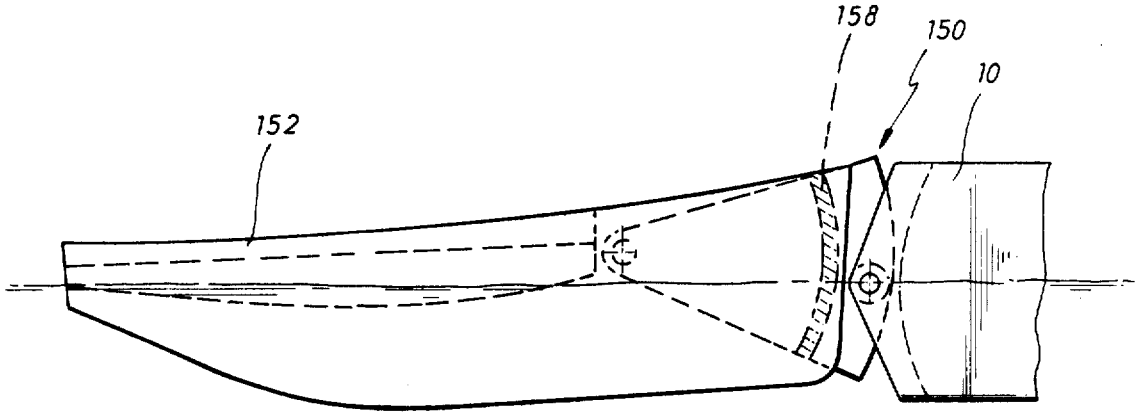
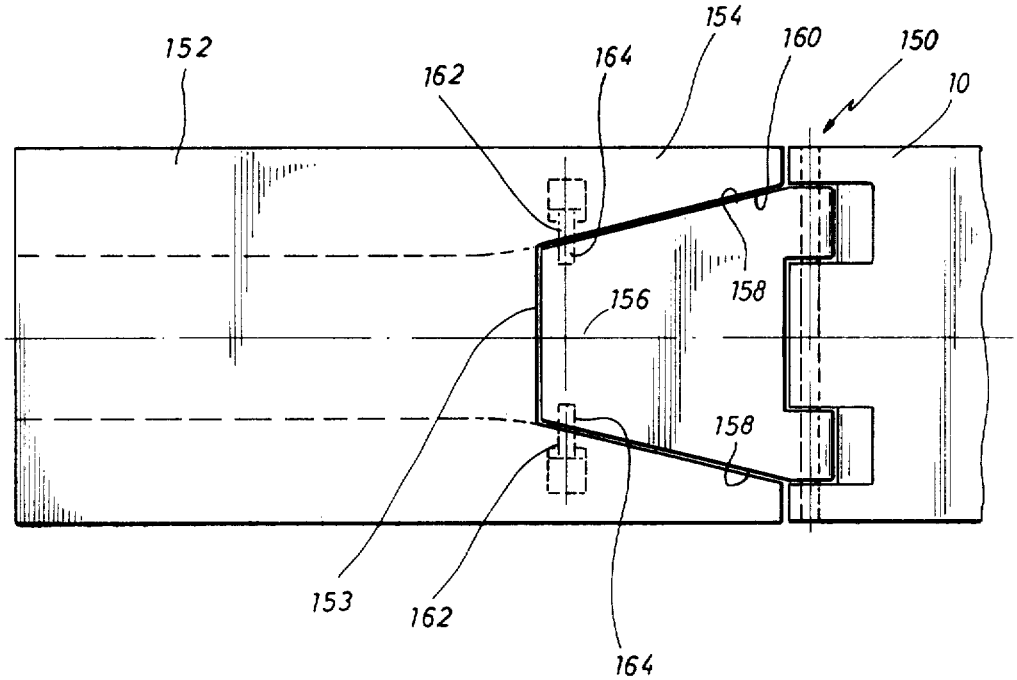
FIG. 23

NON-ROLL TUG-AND-BARGE LINKAGE

CROSS REFERENCE TO RELATED APPLICATION

This application is a continuation-in-part of my application entitled Non-Roll Tug-and-Barge Linkage, Ser. No. 138,642, filed Apr. 8, 1980, now abandoned.

BACKGROUND OF THE INVENTION

The invention relates to apparatus for towing seagoing vessels and more particularly it relates to linkages for utilization during the towing by pushing of non-propelled barges by tugboats.

In the past, non-propelled barges have been transported through the water by either "pushing" the barge from the stern by a tugboat or by "pulling" the barge at the end of a line connected to the stern of the tugboat and the bow of the barge. This application relates particularly to the former method which in the past has usually been accomplished by connecting the tugboat to the stern of a barge by a suitable linkage such as illustrated in applicant's U.S. Pat. No. 3,568,621.

Prior tugboat and barge linkages have usually allowed freedom of movement for pitching, heaving and rolling. Such movement was generally permitted because it was believed advantageous to allow the tugboat to exhibit such independent response relative to the barge. It has been found, however, that in many instances the relative rolling, i.e., independent motion around an axis along the centerline of the vessels, should be reduced to a bare minimum. When complete freedom of rolling is allowed, the tug often sustains excessive roll far beyond an acceptable range during steering.

There have been proposals to overcome the problem of relative rolling by means of a truss reinforced frame extending rearwardly from a barge and attaching directly to either side of a tugboat. Such an arrangement however requires a highly rugged construction.

It has further been proposed to provide mating surfaces between a tugboat and a barge having a stern recess to receive the bow of the tugboat as shown in applicant's U.S. Pat. No. 3,568,621, which is incorporated by reference, in order to minimize roll. While such an arrangement is effective to preclude or inhibit rolling of the tugboat relative to the barge, when the two are joined by a pivotal connection, the required surface area for the mating surfaces must be enlarged because of the many variables which determine where the sides will contact. That is, the relationship between the sides is dependant upon the pitching of the barge, the pitching of the tugboat, the pivotal motion of the linkage at the barge, whether due to heaving or pitching of either of the vessels, and the pivotal motion of the linkage at the tugboat, whether due to heaving or pitching of either of the vessels. The combination of all of these relative motions has therefore required, for example, a slot of up to eight feet in depth with a suitable matching protrusion for a tugboat-barge combination similar to that shown in applicant's patent.

Hence, to provide an improved linkage for barges and tugboats wherein it is desired to push a non-propelled barge by a tugboat, it is desirable to provide a device which eliminates the need for extended surfaces in the stern of the barge, one which provides readily defined mating surfaces, and one which minimizes strength requirements of the linkage structure.

SUMMARY OF THE INVENTION

The present invention provides an apparatus for coupling first and second vessels wherein the apparatus minimizes roll of one vessel relative to the other while permitting freedom of movement for pitching and heaving of one vessel relative to the other. More specifically, the apparatus provides a means for coupling a tugboat to a non-propelled barge for pushing the barge wherein the apparatus minimizes roll of the tugboat relative to the barge while permitting freedom of moement for pitching and heaving of the tugboat relative to the barge. To accommodate such coupling, a notch may be included in the stern of the barge to receive the bow of the tugboat or in the bow of the tugboat to receive the stern of the barge. For simplicity, reference will be made to a tugboat which represents a second or pushing vessel and a barge which represents a first or lead vessel. It should be apparent, however, that the structure could function to connect two segoing vessels such as two barges if desired.

The apparatus is generally represented by a rearwardly extending linkage frame or linkage pivotally secured to the stern of the barge along a substantially horizontal axis. The linkage defines a recess generally facing the bow of the tugboat wherein the recess has elongated, inner opposing surfaces which surfaces may be parallel. An alignment means is further secured to the tugboat for aligning the bow or a member of the bow of the tugboat between the inner opposing surfaces of the linkage such that roll of the tugboat relative to the barge is minimized. Typically, such means can take the form of outwardly facing surfaces which can engage and mate with the opposed surfaces of the barge. Additionally, the apparatus includes a means for securing the tugboat to the linkage such that freedom of movement for pitching and heaving of the tugboat relative to the barge is permitted. Typically, the securing means may comprise a pivotal connection between the linkage and the tugboat.

By so placing the mating surfaces on the linkage and either the tugboat or barge, whichever vessel does not include the linkage, the mating surfaces are dependent only upon the motion of the vessel having the mating surfaces relative to the linkage. This motion will, in turn, typically be rotational about the point of attachment, thereby describing a simple arcuate path for the mating surfaces.

In a preferred embodiment of the present invention, the linkage comprises a unitary body having an elongated vertical slot generally facing the tugboat. The slot defines elongated, inner opposing surfaces. The alignment means may then comprise an elongated protrusion comprising first and second opposing elongated aligning surfaces. The surfaces have a configuration such that the protrusion closely fits within the first and second inner opposing surfaces in the slot. In this manner, the protrusion acts against the inner surfaces of the slot to minimize roll of the tugboat relative to the barge.

In an alternative embodiment of the present invention, the stern of the barge has a large recess to receive a major portion of the bow of the tugboat. The linkage may comprise opposing, rearwardly extending arms pivotally secured along a common substantially horizontal axis to the rear of the stern of the barge, one arm on each side of the recess. Each arm includes an elongated inner opposing surface facing inwardly toward the center of the recess. The tugboat comprises aligning surfaces secured to opposite sides such that the surfaces are parallel to and closely aligned with the inner opposing surfaces secured to the linkage frame.

In another aspect of the invention, the apparatus may include first and second arms secured to the linkage and extending rearwardly from the stern of the barge along opposite sides of the tugboat when the tugboat is aligned in place. These arms may be rigid members of either a fixed length or an adjustable length. The arms may further comprise a means for pivotally securing the first and second arms to the tugboat at substantially opposite points along the length of the tugboat such that pitching and heaving of the tugboat relative to the barge is permitted.

In a more preferred aspect of the present invention, the inner opposing surfaces have a vertical arcuate configuration such that the concave side of the opposing surfaces faces rearwardly toward the tugboat. In this aspect, the inner and outer radii of the arcs defined by the surfaces are sufficient to maintain the mating surfaces of the alignment means between the opposing surfaces upon pitching and heaving of the second vessel relative to the first vessel.

In an alternative embodiment of the present invention, the linkage and tugboat further comprise matching slots and key members securing the tugboat on each side to the linkage such that the key members engage slidably within the slots to permit vertical heaving while restricting fore and aft movement of the tugboat relative to the barge. The slots or key members are further mounted such that relative pitching of the tugboat is permitted. In a preferred aspect of this embodiment, the tugboat comprises outwardly facing slotted members secured to either side of the vessel. The slotted members are open at the top and bottom and comprise within the slot a surface facing generally forward, a surface facing generally rearward, and a mating surface. The linkage comprises opposing key members corresponding in position to each of the tugboat slots. The key members are elongated and each include a surface facing generally forward, a surface facing generally rearward and an inner opposing surface. The key member has outer dimensions such that it fits closely within the slot such that vertical heaving movement of one vessel relative to the other is permitted while fore and aft movement of the tugboat relative to the barge is restricted. The linkage is further pivotally mounted to the barge in order to permit pitching of one vessel relative to the other.

In an alternative embodiment of the present invention, the apparatus comprises a linkage secured to the stern of the barge extending rearward to either side of the second vessel. The apparatus further includes a securing means for pivotally securing the second vessel to the linkage wherein the linkage and securing means each comprises arcuate surfaces horizontally positioned transverse to the second vessel in concentric alignment. The surfaces have substantially equal radii such that the surfaces fit within each other to permit pivotal movement of the second vessel relative to the linkage while minimizing roll of the second vessel relative to the first vessel.

Accordingly, the present invention overcomes the previously discussed problems through a device wherein the roll retarding surfaces, if any, are dependent only upon the rotation of the tugboat relative to the linkage, thereby eliminating the need for extended surfaces in the stern of the barge.

BRIEF DESCRIPTION OF THE DRAWINGS

This invention will further be illustrated by reference to the appended drawings which illustrate particular embodiments of the device in accordance with this invention.

FIG. 1 is a side view illustrating a linkage in accordance with the present invention pivotally secured to a tugboat.

FIG. 2 is a partial sectional view taken along section line II—II in FIG. 1.

FIG. 3 is a side view of an alternative embodiment of the present invention.

FIG. 4 is a partial sectional view taken along section line IV—IV in FIG. 3.

FIG. 18 is a side view illustrating an alternative embodiment wherein elongated inner bearing surfaces are included to absorb the steering moment of the tugboat.

FIG. 19 is a plan view of the assembly shown in FIG. 18.

FIG. 20 is a side view of an additional embodiment including elongated inner bearing surfaces to absorb the steering moment of the tugboat.

FIG. 21 is a plan view of the assembly shown in FIG. 20.

FIG. 22 is a side view of an alternative embodiment of the present invention illustrating an adaptation of the linkage to a barge-catamaran tugboat combination.

FIG. 23 is a plan view of the assembly shown in FIG. 22.

DETAILED DESCRIPTION OF THE PREFERRED EMBODIMENTS

Figure 6:
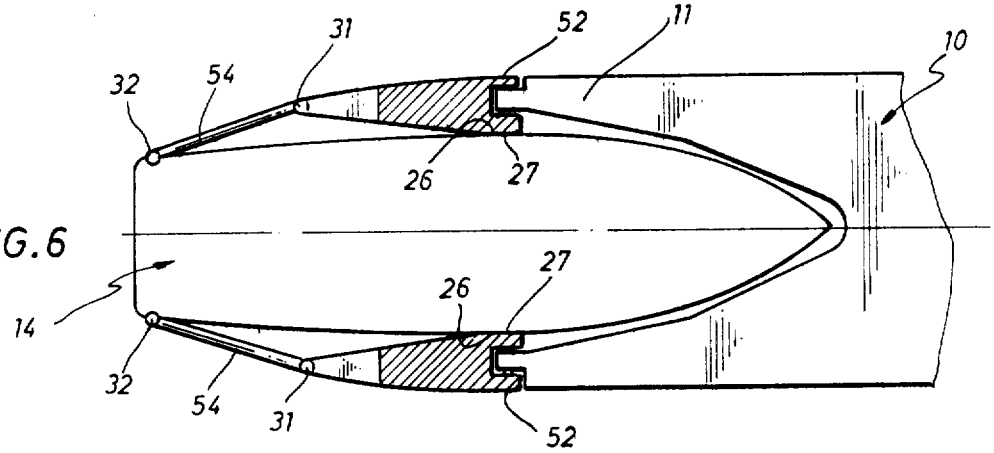
FIG. 6 is a partial sectional view taken along section line VI—VI in FIG. 5.

It will be noted that like parts appearing in several views of the drawings will bear like reference numerals. Further, for simplicity, the majority of the embodiments shown will pertain to mono-hull tugboats. It will be understood by those of skill in the art, however, that the linkages described may also be adapted to catamaran tugboats having twin hulls.

Referring now to FIGS. 1 and 2, seagoing vessels may tend to exhibit linear motion in any of the directions represented by the X, Y, or Z axes as illustrated. Further, vessels may exhibit rotational motion about any of these axes. In common nomenclature, rotational motion about the X axis is referred to as pitching, rotational motion about the Y axis is rolling and rotation about the Z axis is either yawing or steering movement. Similarly, linear motion along the X axis is side drift, along the Y axis is the desired propulsion ahead or astern, and along the Z axis is bobbing or heaving. Also, relative movement along the Z axis may represent changes in draft as caused by changes in loading. These three linear motions and three rotational motions will completely define any movement of the vessel from an analytical standpoint.

Accordingly, the present invention is generally represented by a linkage frame or linkage 20 pivotly mounted to a stern 11 of a barge 10. The linkage 20 is secured to the stern 11 of the barge 10 along a substantially horizontal axis parallel to the X axis (transverse the barge 10) such that it rotates vertically around the X axis shown in FIG. 2. In this manner, the linkage allows the heaving motion of a tugboat 14 relative to the barge 10 when the tugboat 14 is connected to the barge 10 by means of the linkage 20.

The linkage 20 generally defines a recess facing the tugboat and has elongated inner opposing surfaces 26. The surfaces 26 may further comprise a material suitable for bearing surfaces in order to minimize any friction from contact.

The apparatus further generally comprises a means for aligning the bow of the tugboat 14 between the inner opposing surfaces 26 of the linkage 20. This means may typically comprise vertical mating surfaces 27 positioned such that they are received closely within the inner opposing surfaces 26 of the linkage 20 in order to minimize roll of the tugboat relative to the barge 10. The mating surfaces 27 are generally secured to the tugboat 14 either on a protrusion at the bow of the tugboat such as 28 shown in FIG. 2 or along the sides of the tugboat 14 as shown in FIGS. 3–11 and FIGS. 15–18 such that they correspond in position to the inner opposing surfaces 26 of the linkage 20 when the tugboat 14 is in position to be secured to the linkage 20.

Figure 9:
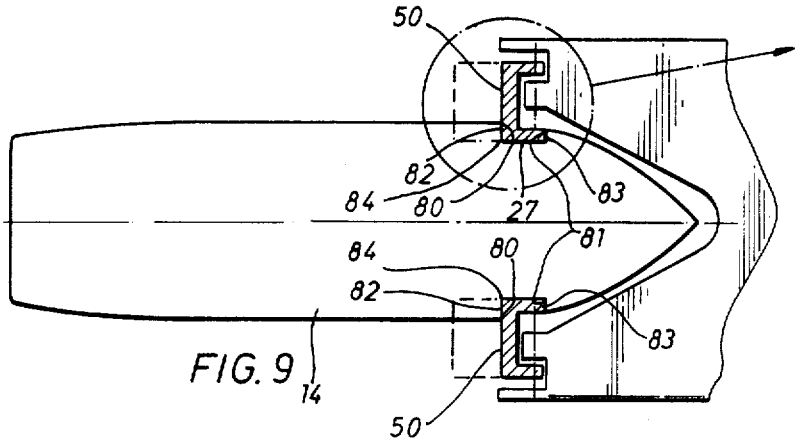
FIG. 9 is a plan view of another alternative embodiment of the present invention.

The apparatus may further comprise opposing compression surfaces, such as 38 and 35 shown in FIG. 1 or 80 and 82 in FIG. 9, between the tugboat 14 and the barge 10 whereby the tugboat 14 may propel the barge 10 by means of direct contact between the tugboat 14 and the linkage 20. As will be understood, however, these surfaces are optional for those linkages having a sufficiently rigid construction to prevent contact between the tugboat and barge. The opposing compression surfaces should have, when included, a configuration, such as an arcuate configuration, which permits the pitching and heaving of the tugboat 14 relative to the barge 10 when the surfaces are in contact.

The apparatus additionally includes a means for securing the tugboat 14 to the linkage 20 such that freedom of movement of the tugboat 14 relative to the barge 10 for pitching and heaving is accommodated. The means may comprise a connector providing pivotal movement between the tugboat 14 and the linkage 20 such as universal joints, pin joints, or other suitable pivotal connecting means. In this manner the pivotal relationship between the linkage 20 and the tugboat 14 and the above-mentioned connection between the linkage 20 and the barge 10 act in unison to provide freedom of movement for heaving and pitching of the tugboat 14 relative to the barge 10.

Referring again to FIG. 1, in a preferred embodiment, the linkage 20 comprises a unitary body 22 which is pivotally secured to the stern 11 of the barge 10 by pin joints 24 or other suitable means. The unitary body 22 has a slot 25, which faces generally rearwardly toward the tugboat 14 in use. The slot 25 has a vertical arcuate configuration, the arc of the slot 25 having a substantially constant radius, the centerpoint of which is defined by the connecting point of the linkage 20 to the tugboat 14 as explained below. The slot 25, in this embodiment, has substantially parallel inner opposing surfaces 26 and a relatively constant depth throughout, whereby the slot, in cross-section has a substantially rectangular configuration open toward the tugboat 14, as shown in FIG. 2.

The tugboat 14 comprises a protrusion 28 secured to its bow for engaging the slot 25 of the linkage 20. The protrusion 28 includes a means for aligning the bow of the tugboat 14 between the inner opposing surfaces 26 of the linkage 20. In particular, the alignment means comprises opposing mating surfaces 27 having a position and width such that the mating surfaces 27 closely fit within the inner opposing surfaces 26. The protrusion 28 may further have an elongated arcuate configuration substantially similar to the arcuate configuration of the slot 25. More particularly, as shown in FIG. 1, the arcurate protrusion 28 defines an arc, the centerpoint of which also corresponds to the connecting point of the linkage 20 to the tugboat 14, such that the arcuate protrusion 28 maintains a constant clearance 23 from the bottom of the slot 25 when the tugboat 14 is pivotally secured to the linkage 20 by a rigid member at the connecting point.

Figure 13:
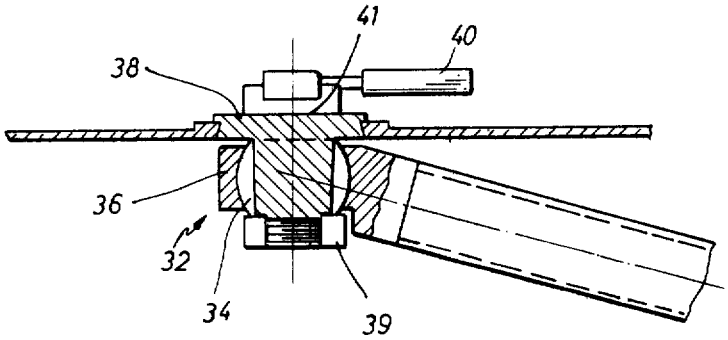
FIG. 13 is a partial cross-sectional view of the pivotal connection of the linkage to the tugboat taken along the line XIII—XIII in FIG. 1.

In the preferred embodiment, the unitary body 22 comprises opposing arms 29 and 30 pivotally secured to the unitary body 22 on either side of the tugboat 14 along a vertical axis substantially perpendicular to a line extending between the pin joint 24 and the connector 32. These arms 29 and 30 may comprise substantially rigid members having a fixed length or an adjustable length and include a connector 32 providing pivotal movement between the tugboat 14 and the linkage 20. The connector 32 may comprise a universal joint such as illustrated in FIG. 13 or other suitable means for pivotally connecting the arms to the tugboat 14 in order to accommodate the pitching motion of the tugboat 14 in relation to the barge 10. It should be understood that in this embodiment, the propulsion of the barge 10 by the tugboat 14 may be effected entirely through the arms 29 and 30 and the linkage 20 because of the rigidity of the arms 29 and 30.

Referring to FIG. 13, there is illustrated the connector 32 for pivotally securing the linkage 20 to the tugboat 14 shown in FIG. 1. The connection illustrated in FIG. 13 comprises a universal joint 33 including a spherical sleeve 34 and a casing 36. A cantilever 38 extends through the spherical sleeve 34 and is secured therein by a nut 39. The cantilever 38 includes a stem 41 which is securable to a hydraulic cylinder 40 secured to the tugboat 14 (not shown) by a bayonet coupling or other suitable means. The universal joint 32 thereby provides the freedom of movement necessary for pitching and heaving of the tugboat 14 relative to the barge 10. It should be understood by those skilled in the art, however, that other suitable joints, such as other types of universal joints, pin joints, or other connectors may be utilized in accordance with the present invention to provide the freedom of movement of the tugboat 14 relative to the barge 10 to accommodate pitching and heaving.

Hence, for the embodiment shown in FIG. 1 the bow of the tugboat 14 may sweep a constant arc relative to the points of attachment of the universal joints 32 upon pivoting about those points. The radius of the arc will, in turn, approximate the distance along the center line of the tugboat 14 from the points of attachment of the universal joints 32 to the forward most point of the tugboat. Accordingly, as stated above, by defining the arc of the protrusion 28 of the tugboat 14 and the arc of the slot 25 to concentrically correspond to the arc demonstrated by the pivoting of the tugboat 14, it is possible to maintain a constant clearance 23 between the bow of the tugboat 14 and the bottom of the slot 25 of the linkage frame 20.

While in this embodiment, the slot 25 has an arcuate configuration of relatively constant depth, it should be understood that the depth and configuration of the slot 25 may vary so long as the inner opposing surfaces 26 remain in contact with the mating surfaces 27 for all ranges of pitching and heaving of the tugboat 14 so that roll may be minimized.

As an alternative embodiment (not shown) to the embodiment in FIGS. 1 and 2, the protrusion may comprise extendable members wherein the members engage in an arcuate slot in the inner opposing surfaces of the linkage 20. In this variation, the arc of arcuate slot must have a configuration substantially concentric with the center of pitching for the tugboat to have freedom of motion for pitching.

Referring now to FIGS. 3 and 4, there is shown an alternative embodiment of the present invention. In this embodiment, the barge 10 has a large recess 15 in the stern 11 to receive a portion of the tugboat 10. The linkage 20 comprises opposing arms 50 secured by pivotal connectors 52 on either side of the large recess 15 to the rear of the stern 11 of the barge 10 along a common horizontal axis transverse to the barge such that the arms 50 may rotate in unison in the manner described for the unitary embodiment described above. The pivotal connectors may comprise pin joints or other suitable pivotal connecting means as are commonly known in the art.

The arms 50 each further comprise an inner opposing surface 26 similar in function to the inner opposing surfaces 26 described above for the embodiment shown in FIG. 1. The tugboat 14 in turn comprises opposing mating surfaces 27 as the means for aligning the bow of the tugboat between the inner opposing surfaces 26 of the linkage 20 such that roll of the tugboat 14 relative to the barge 10 is minimized. The mating surfaces 27 should be vertically oriented such that they remain substantially near or in contact with the inner opposing surfaces 26 upon pitching and heaving of the tugboat 14. Further, either the inner opposing surfaces 26 or the mating surfaces 27 should be elongated to account for the heaving and pitching of the tugboat relative to the barge. In the preferred embodiment, the inner opposing surface 26 has an elongated arcuate configuration wherein the radii of the arcs defined by the surface approximate the distance from a point of securing the linkage 20 to the tugboat 14 to the respective inner and outer edges of the opposing surface 26.

The linkage 20 may further include opposing extensions 54 pivotally secured along vertical axes to the opposing arms 50 wherein the extensions 54 are similar in construction and purpose to the opposing arms 29 and 30 described above. By the same token, the extensions 54 may be pivotally secured to the tugboat 14 by connectors 32 as described above.

This embodiment has the advantage of facilitating the fastening of the linkage 20 to the tugboat 14 near the stern of the tugboat 14. Generally speaking, the more that the effective recess 15 within the barge 10 is extended by the linkage 20, the more the tugboat 14 will be supported by the pivotal connection 52 at the barge 10. Hence, if the effective depth of the recess 15 is extended to half the distance of the tugboat 14 and the connectors 32 are moved to the stern of the tugboat 14 as shown in FIGS. 5 and 6 the tug may be almost entirely supported by the barge at the pivoting hinge 52 and forces at the connector 32 will thereby be diminished.

Figure 5:
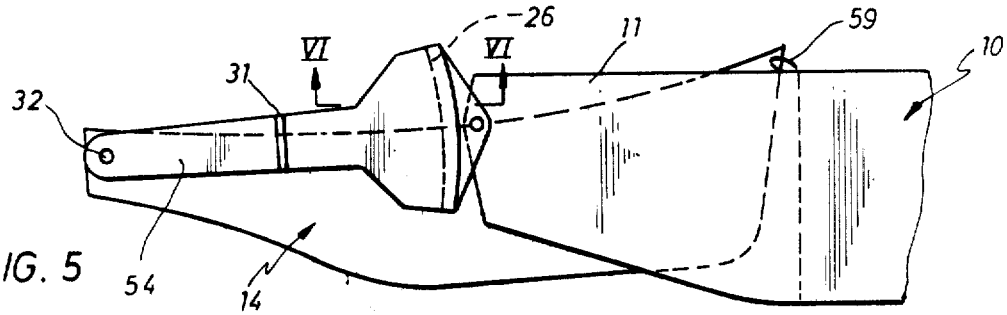
FIG. 5 is a side view of an alternative embodiment of the present invention.

It may additionally be possible to essentially eliminate relative pitching of the tugboat 14 when desired by restraining vertical movement of the bow of the tugboat 14 by, for example, tying the bow to the stern of the barge 10 by a chain 59 or other suitable connection as shown in FIG. 5. Additionally, a hydraulic cylinder 60 (as shown in FIG. 3) may be connected between the arms 50 and the tugboat 14 by bolts or other suitable means in order to dampen the motion response of the tugboat 14 relative to the arms 50.

Figure 7:
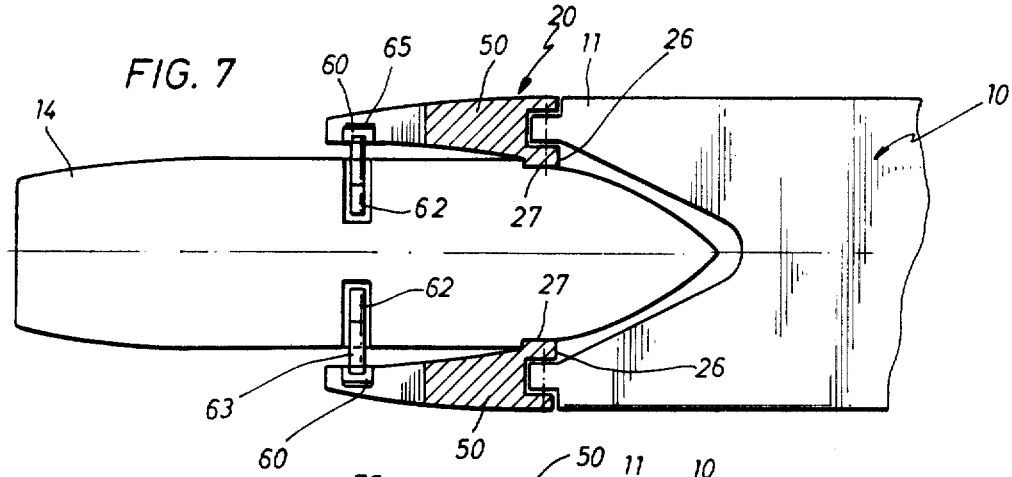
FIG. 7 is a partial sectional view of an additional embodiment of the present invention wherein the linkage has a similar configuration to that illustrated in FIGS. 1, 3 and 5, illustrating an alternative means for pivotally securing the tugboat to the linkage frame.

Referring now to FIG. 7, there is shown another means for securing the tugboat 14 to a linkage 20. This securing means includes a rod 63 and mating bore 65 positioned on each side of the tugboat 14. In this embodiment, the rod 63 is extendable into the bore 65 such that the rod 63 restricts fore and aft as well as athwartship movement of the tugboat 14 relative to the linkage 20 while permitting pivotal movement of the tugboat 14. In the preferred embodiment of this aspect of the invention, the opposing arms 50 comprise rigid extended members, each comprising a universal joint 60 having the bore 65 therethrough. The tugboat 14 comprises opposing hydraulic cylinders 62 having extendable rods 63, the cylinders 62 being secured to each side of the tugboat 14 and positioned such that upon alignment of the tugboat 14 between the inner opposing surfaces 26, the hydraulic cylinder rods 63 may be extended outwardly to engage within the bore 65 of the respective universal joints 60. In this manner, the hydraulic cylinders 62 and rods 63 pivotally secure the opposing arms 50 to the tugboat 14 at substantially opposing points to allow freedom of motion for pitching and heaving.

Alternatively, the hydraulic cylinder 62 could be mounted on the arms and be extendable to engage in a universal joint or other bore in the tugboat. It should be understood that this same securing means could also be applied to the embodiments shown in FIGS. 1-6 so long as the arms are not allowed to pivot horizontally to disconnect in normal operation.

Figure 8:
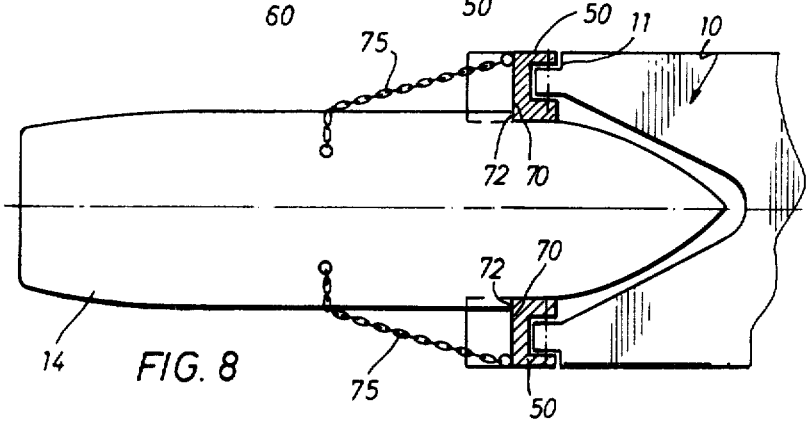
FIG. 8 is a partial sectional view of another embodiment of the present invention having a similar arcuate configuration.

FIG. 8 illustrates another embodiment of the present invention wherein the opposing arms 50 further comprise compression surfaces 70. The compression surfaces 70 face rearwardly toward the tugboat 14 and may include a suitable compression bearing surface secured thereon. The tugboat 14 comprises opposing compression surfaces 72 to engage with the arm compression surfaces 70 for propulsion of the barge 10 by the tugboat 14 by pushing. The means for securing the linkage frame arms 50 to the tugboat 14 then comprises chains 75 or other suitable connecting members. It should be understood that because of the compression surface 70 restricting the forward movement of the tugboat 14 relative to the barge, a rigid member is not needed to connect the linkage frame arms 50 to the tugboat 14. Rather, the connector need only restrict the rearward movement of tugboat 14 relative to the barge 10. Further, as stated above, the compression surfaces for this embodiment should have a suitable configuration to accommodate pitching and heaving of the tugboat 14 such as the arcuate configuration shown for the surfaces 35 and 38 in FIG. 1.

Figure 14:
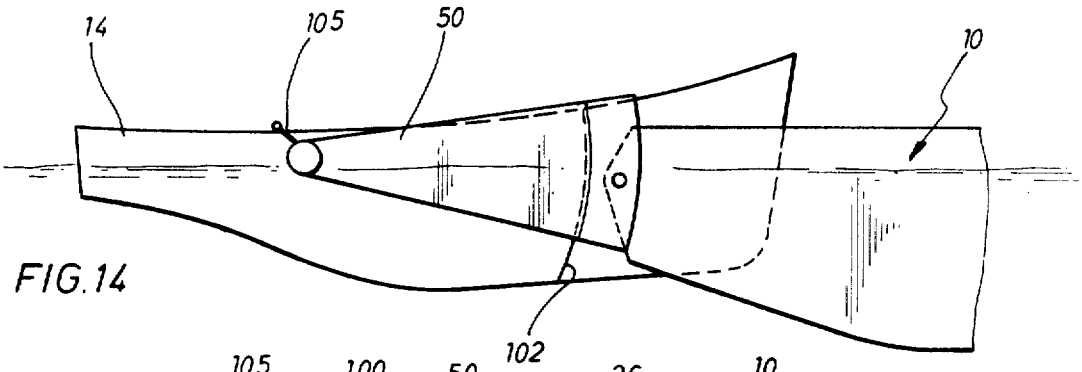
FIG. 14 is a side view illustrating an additional embodiment of the present invention having compression surfaces for propulsion.
Figure 15:
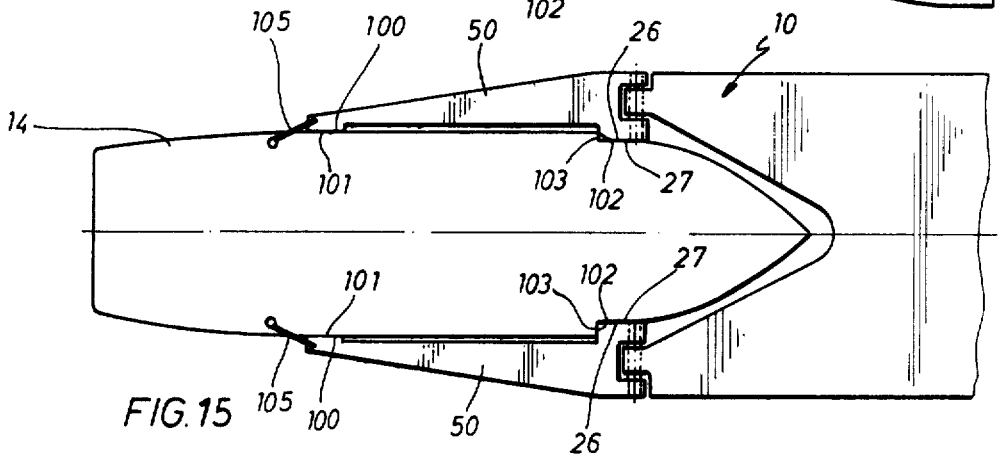
FIG. 15 is a plan view of the linkage frame assembly shown in FIG. 14.

FIGS. 14 and 15 illustrate another embodiment of the present invention wherein the opposing arms 50 are extended rearward to provide athwartship support against yawing. In the preferred embodiment, the arms 50 are rigid and include opposing mating surfaces 27 similar in shape and function to those described for FIGS. 1-8. The arms further include yaw restricting surfaces 100 which contact the tugboat on either side at corresponding points 101. The corresponding points 101 may comprise suitable bearing surfaces to minimize the friction from contact. The arms 50 may further include a rearward facing compression surface 102 wherein the tugboat 14 comprises forward facing compression surfaces 103 to provide propulsion surfaces for pushing the barge by the tugboat. The arms 50 are then linked to the tugboat 14 by a connector 105 such as a cable or other suitable linking connector. It should be understood that the present embodiment reduces the forces on the connector 105 from those forces exerted on the chains 75 in FIG. 8 because of the athwartship support against yawing. Therefore, the connector 105 may comprise a wire rope, a light chain, or other similar device.

Figure 16:
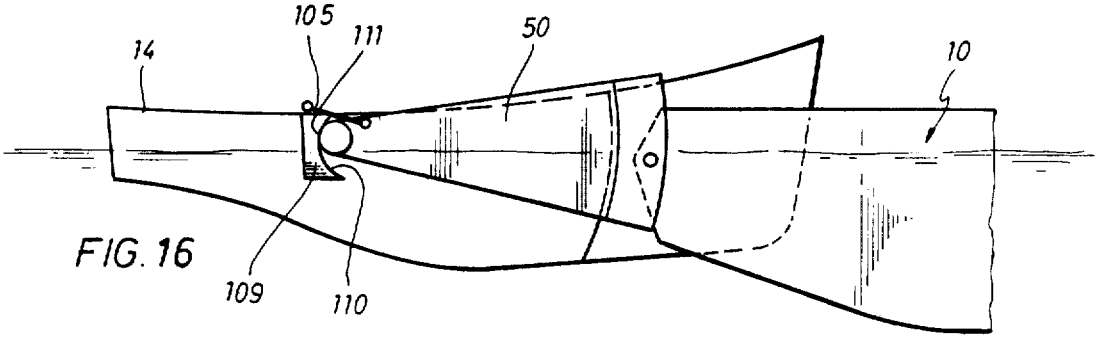
FIG. 16 is a side view illustrating an additional embodiment of the present invention having rearwardly located compression surfaces for propulsion.
Figure 17:
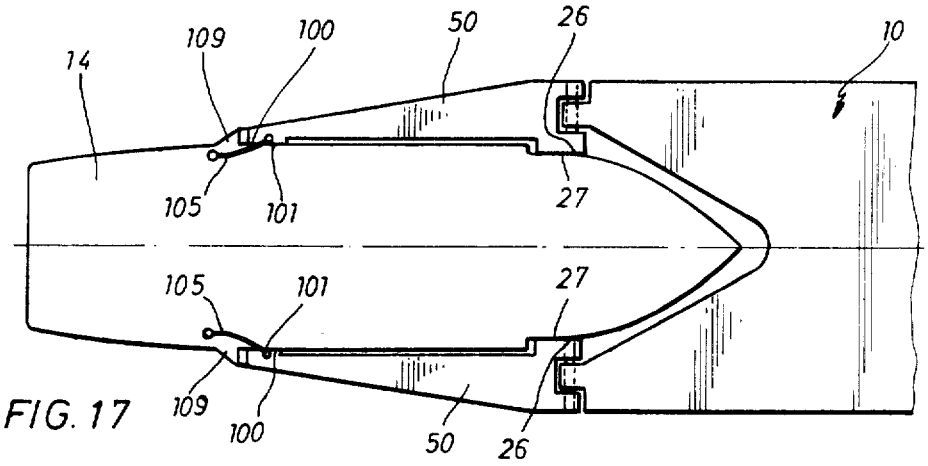
FIG. 17 is a plan view of the device shown in FIG. 16.

Referring to FIGS. 16 and 17, there is shown another embodiment of the present invention providing athwartship support against yawing. In this embodiment, the tugboat 14 comprises forward facing compression guides 109 positioned at opposing points on either side of the tugboat 14. The compression guides 109 include forward facing compression surfaces 110 secured to the forward side of the guides 109.

The opposing arms 50 for this embodiment taper to a rounded end of roughly constant width and include rearward facing compression surfaces 111 having a configuration suitable to mate with the forward facing compression surfaces 110 for propulsion of the barge 10 by the tugboat 14. The arms 50 further include yaw restricting surfaces 100 similar in function to those described above for FIGS. 14 and 15 as well as opposing mating surfaces 27 for preventing roll. In turn, the tugboat 14 comprises corresponding points 101 and inner opposing surfaces 26 similar in function and shape to those described for FIGS. 14-15 above. The arms 50 are secured to the tug by a connector 105 similar in construction to the connector in FIGS. 14 and 15.

In a preferred aspect of this embodiment, the rearward facing compression surfaces 111 and forward facing compression surfaces 110 are arcuate such that the arms 50 tend to remain seated in the respective guides 109 for varying draft and heave. It should be understood that similar guides may be provided for the device shown in FIGS. 14 and 15 wherein the guides and arms are not in constant contact due to the contact between compression surfaces 102 and 103 as shown.

Figure 10:
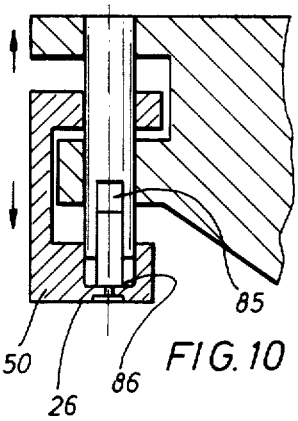
FIG. 10 is an exploded view of the linkage frame assembly illustrated in FIG. 9.
Figure 11:
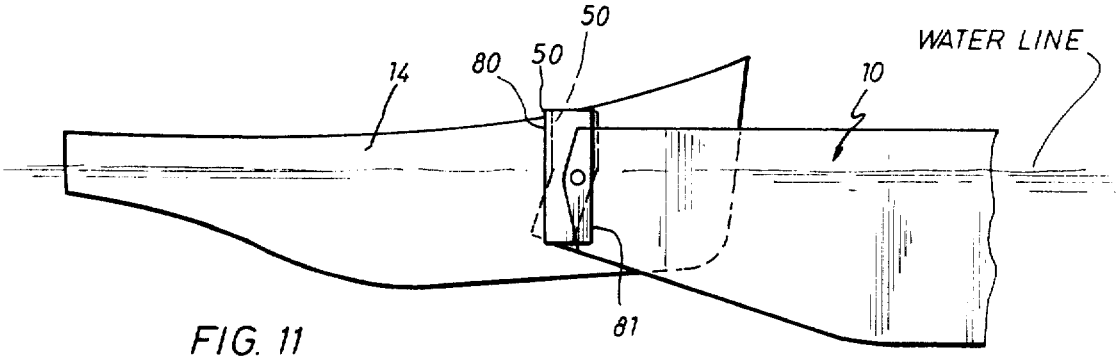
FIG. 11 is a side view of the tugboat-linkage frame-barge combination of FIG. 9.

FIGS. 9-11 illustrate another embodiment of the present invention comprising matching slots and key members to secure the tugboat to the barge. In the preferred aspect of this embodiment, each arm 50 acts as a key member and includes a rearward facing compression surface 80 and a forward facing compression surface 81. The tugboat 14 in turn comprises a forward facing compression surface 82 on each side to mate with the opposed rearward facing surface 80 and a rearward facing surface 83 on each side to mate with the opposed forward surface 81 of the linkage arm 50, thereby forming a slot to receive the arm. The facing surfaces 80 and 82 and 81 and 83 are selectively engaged by the linear movement of the arm 50 into a slot 84 provided within the tugboat 14. The linear movement of the arm 50, in turn, may be provided by a single hydraulic cylinder 85 (as shown in FIG. 10) having an extendable rod 86, the cylinder 85 being secured to one side of the stern 11 of the barge 10 and pivotally secured to the opposing arm 50 corresponding to that side of the barge. Movement of the hydraulic cylinder piston 86 therefore moves the opposing arm 50 inwardly to engage the slot 84 of the tugboat 14. It should be understood that as in the above embodiments, the arm 50 comprises an inner opposing surface 26 and the tugboat comprises a mating surface 27 to minimize roll of the tugboat relative to the barge.

Additionally, in a preferred aspect of this embodiment, the rearward facing surface 80 is elongated in either a straight line or in an arcuate configuration (ghosted in) while the forward facing surface 81 is also elongated parallel to the rearward facing surface 80 in order to provide sufficient contact surface for propulsion for all variations in the draft of the barge 10.

As will be understood, the slots on the tugboat could instead be movably secured to engage with the surfaces of the linkage. Further, the respective positions of the slots and the key members on the tugboat and the linkage could be varied or reversed to obtain essentially the same result.

For those instances where it is desirable to minimize relative heave as well as roll, it is possible to eliminate the pivotal capability of the linkage at the stern. An apparatus is then provided comprising a linkage secured to the stern of the barge and extending rearwardly to either side of the second vessel. The linkage and tugboat comprise a securing means for movably securing the tugboat to the linkage such that only pivotal motion of the tugboat relative to the linkage is permitted, thereby eliminating relative heave and roll while permitting relative pitching. The securing means may comprise substantially concentric, arcuate surfaces horizontally positioned transverse to the tugboat, the surfaces having substantially equal radii such that the surfaces fit within each other to permit the desired pivotal movement.

Figure 12:
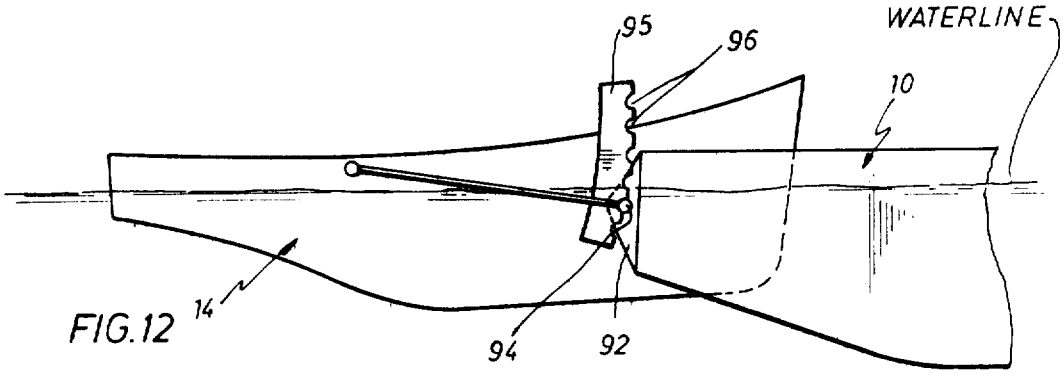
FIG. 12 is a side view illustrating another alternative embodiment of the present invention.

Referring now to FIG. 12, a preferred embodiment of this aspect of the invention includes an apparatus for coupling a non-propelled barge 10 to a tugboat 14 wherein the barge 10 has a large recess 15 in the stern of the barge 10 to receive a major portion of the bow of the tugboat 14. The apparatus comprises opposing arms 92 secured on each side of the recess to the rear of the stern of the barge 10. Each arm 92 may comprise an inner opposing elongated surface (not shown), identical in nature and function to the inner opposing surfaces 26 with the tugboat having mating surfaces 27 as described above; but if the securing means is sufficiently rigid, these surfaces are not required. In this embodiment, a rearwardly facing horizontal roller 94 is secured to each opposing arm 92 such that the roller 94 is transverse to the barge 10. The tugboat 14 comprises opposing arcuate bearing surfaces 95 secured to each side of the tugboat 14, each opposing bearing surface 95 having a plurality of arcuate indentations 96 having a radius substantially equal to the outer radius of the horizontal rollers 94 for engaging the rollers 94. A means for connecting the arm 92 to the tugboat 14 is further included. In the preferred embodiment, this means may comprise a chain, wire rope or other suitable connector having a substantially constant length and sufficient strength for fastening the tugboat 14 to the barge 10.

As will be understood, the arcuate bearing surfaces 95 could be secured to the arms 92 with the roller 94 being secured to the tugboat 14.

Hence, the rollers 94 engage in the indentations 96 to secure the tugboat 14 against relative heaving and rolling. The indentations 96, in turn, should have a sufficient length arc to maintain the rollers 94 in place to accommodate pitching and minmize rolling and heaving. In the preferred embodiment, the indentations 96 are substantially semicircular.

It should also be noted that in the embodiment described for FIG. 12 the entire wave forces will be transmitted to linking structures involved. It is advantageous, therefore, to position the point of securement as close to the center of pitching as possible to minimize forces on the structure due to pitching. Further, for severe applications, these structures must be reinforced to withstand waves of exaggerated height.

It should further be understood that the relative position of the arcuate bearing surfaces 95 and the rollers 94 may be reversed wherein the bearing surfaces 95 are secured to the barge and rollers 94 to the tug.

Referring now to FIGS. 18 and 19, there is shown an alternative embodiment of a linkage of the present invention which includes inner bearing surface members 120 pivotally mounted to the barge 10 in order to absorb the steering movement of the tugboat 14. In a specific embodiment, the bearing surface members 120, each have an elongated shape and an inboard bearing surface 122 configured to match the outboard surface 124 of the tugboat 14. It should be understood that it is advantageous for the inboard bearing surfaces 122 to match the outboard shape 124 for any foreseeable draft of either vessel. For tugboats 14 having substantially vertical sides, this may be accommodated by positioning the inner bearing surface members 120 near the middle of the expected range of drafts as shown in FIG. 18. For tugboats having non-vertical sides, however, vertical adjustability of the members 120 may be provided.

Referring still to FIGS. 18 and 19, the linkage further includes a connecting arm 126 pivotally secured at one end to the barge 10 at a point 127. In the illustrated embodiment, the securing point 127 is axially aligned with the point of pivotally securing the bearing surface member 120 to the barge 10 so that the center of rotation of the arm 126 is substantially the same as that for the member 120. The arm 126 may be comprised of any constant length device including a rigid bar or a cable or rope. It should be noticed that the use of a flexible member is accommodated by the bearing surface members 120 which absorb the steering moment of the tug 14. The connecting arm 126 is further pivotally connected to the tugboat by a pin joint or other suitable means.

Referring now to FIGS. 20 and 21, there is shown an alternative embodiment of a linkage similar to that shown for FIGS. 18 and 19. In this embodiment, the linkage includes a bow bearing surface member 130, opposing midsection bearing surface members 138, and a connecting arm 146. The bow bearing surface member 130 may be comprised of two parts, one located on each side of the bow, or it may be a single member as illustrated. In this embodiment, the bow bearing surface member 130 has an elongated inboard bearing surface 132 configured to match the bow outboard surface 134 of the tug 14 and is pivotally secured to the barge 10 so that it may change position with both the pitch and heave of the tug 14. The inboard surface 132 and the outboard surface 134 should be maintained in close contact for various drafts by extending the bearing member 130 longitudinally or by adjustably securing the member for vertical adjustment. The stern of the barge then includes an inner notch 136, in which the member 130 is secured. In side cross-sectional view, the bow bearing surface member 130 is arcuate in configuration so that the member 130 remains in contact with the bow of the tugboat 14 during the pitching and heaving of the tugboat 14.

The midsection bearing surface members 138 have an elongated arcuate shape and include inboard midsection bearing surfaces 140 configured to match the outboard sides 142 of the tug 14. The bearing surfaces 140 are further elongated and configured such that contact with the outboard sides 142 of the tugboat is maintained for any foreseeable draft. In this manner, the bearing surface members 138 and 140 absorb the steering moment as in FIGS. 18 and 19, above.

The connecting arm 146 again may comprise any constant length connector such as a rigid bar or a rope or cable. The connecting arm 146 is pivotally connected to the barge 10 by a pin joint or other suitable device at a point 147 defined as substantially the center of the arcs described by the bearing members 130 and 138; or, to be more precise, the arc of the bearing members may be determined by using the point 147 of connection as the center of the arcs. The connecting arm 146 further is pivotally connected by a pin joint or other suitable device to the tug at a point 148 toward the stern of the tug 14.

Accordingly, the embodiments of FIGS. 18–21 provide a means for absorbing steering moment in order to accommodate a lighter connection between the tugboat and the barge such as the cables 126 and 146 shown therein.

FIGS. 22 and 23 illustrate a linkage 150 in accordance with the present invention suitable for a catamaran tugboat 152 having a notch 153 extending into the bow 154 of the tugboat 152. The linkage 150 includes a unitary body 156 which is pivotally secured to the stern of the barge 10. The unitary body 156 has vertical outwardly-facing surfaces 158 which are positioned to match the inner surfaces 160 of the notch 153 of the catamaran tugboat 152. The outwardly facing surfaces 158 may have an elongated arcuate configuration wherein the center of the arc is defined by the point of attachment of the unitary body 156 to the catamaran tugboat 152.

A means for pivotally securing the unitary body 156 to the tugboat 152 is further included. In the illustrated embodiment, the securing means includes opposing cylinders 162 secured in the opposing inner sides of the notch 153. Each cylinder 162 includes an extendable piston wherein tne piston may be selectively extended inwardly toward the center of the tugboat 152. Matching opposing bores 164 are then included in the unitary body to receive the pistons from the cylinders 162. In this manner, the tugboat 152 may be pivotally secured to the unitary body 156 when desired.

Accordingly, linkage 150 provides a device having mating surfaces and pivotal connections similar in function to those described for the figures above.

Figure 24:
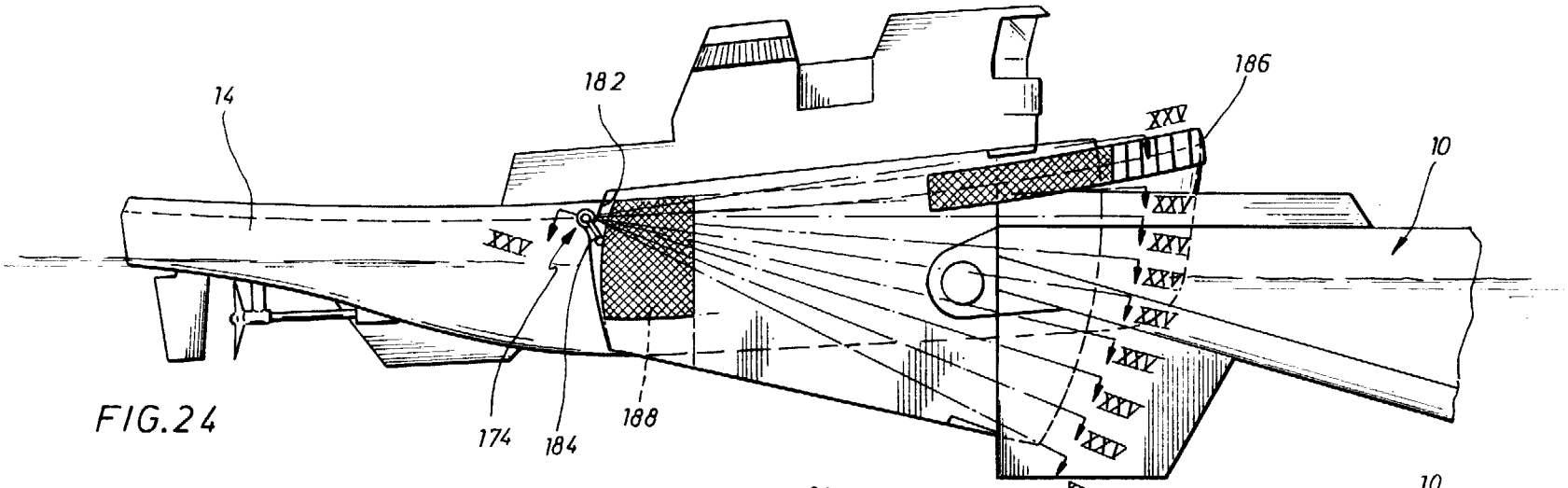
FIG. 24 is a side view of an alternative embodiment of the basic linkage.
Figure 25:
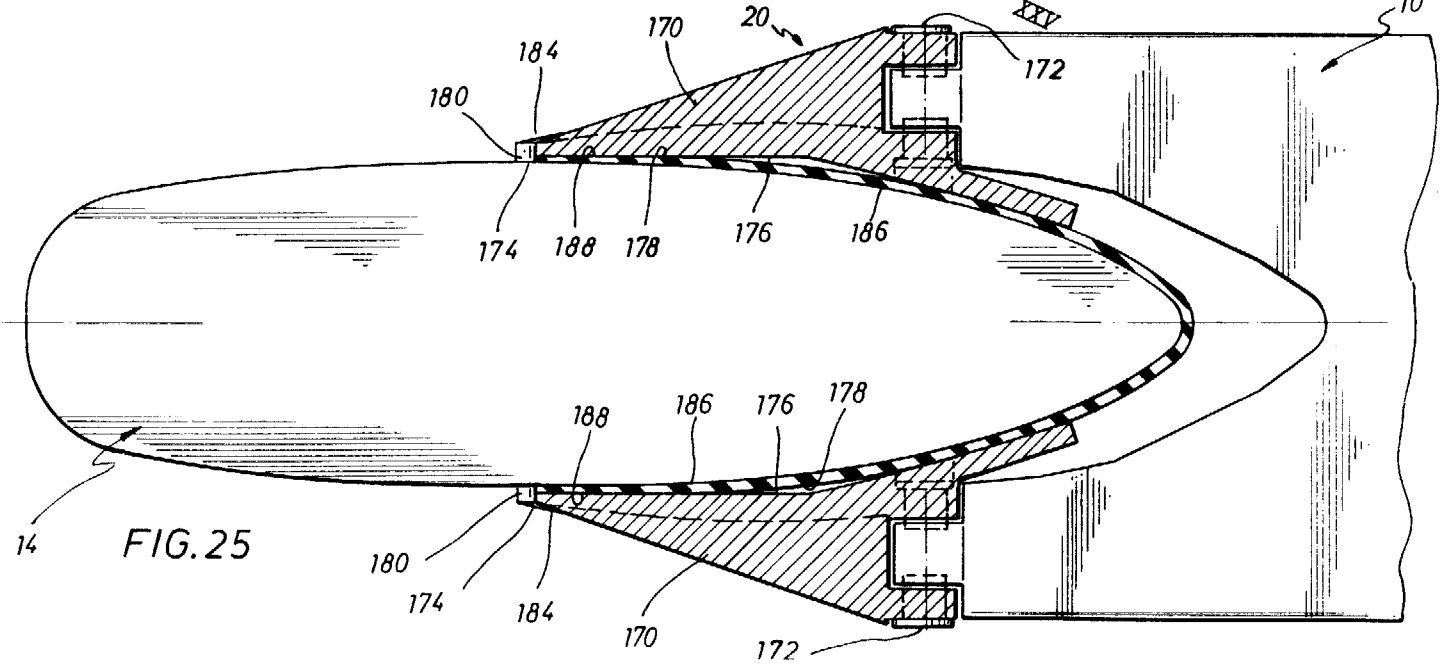
FIG. 25 is partial sectional view of the embodiment illustrated in FIG. 24, illustrating the inboard profile of the linkage along any of the section lines XXV—XXV.

Referring now to FIGS. 24 and 25, there is shown an alternative embodiment of the present invention similar in basic concept to those embodiments illustrated in FIGS. 1–8. In this embodiment, the linkage 20 includes opposing arms 170 pivotally secured to the stern of the barge 10 by pin joints 172 or other suitable connecting means. In the preferred embodiment, the arms 170 extend both forward and rearward of the pivotal connection (pinjoints 172) and are pivotally secured near their rearward end to the tugboat by a "notch and peg" pivotal connector 174 described in more detail below.

The important aspect of this embodiment is the shape of the inboard surfaces 176 of the linkage arms 170. In particular the inboard surfaces 176 are configured to form a mating recess to closely fit the outermost outline 178 (for a predetermined width) of the hull of the tugboat 14 for the various drafts of the barge 10. One way that this may be accomplished is by shaping the inboard surfaces 176 such that the inner profile of the arm 170 closely fits the deck outline 178 of the tugboat 14 for all cross-sectional views of the linkage generated by extending planes XXV—XXV radially outwardly from the point of the pivotal connection 174 as illustrated in FIG. 24. In this manner, the arm 170 will closely fit the hull outline 178 of the tugboat 14 as it pivots around the pivotal connection 174 for various drafts.

Referring still to FIGS. 24 and 25, the pivotal connector 174 may be any connector which provides pivotal movement between the arm 170 and the tugboat 14. In the preferred embodiment, the connector 174 includes a cylindrical peg 180 secured to the side of tugboat 14 perpendicular to the side of the tugboat 14 extending outwardly. The peg is further positioned near the top of the side of the tugboat 14.

The peg 180 is received by an open ended notch 182 positioned at the end of the arm 170. The notch 182 has a quarter-circular arcuate configuration at the bottom and extends vertically to the top of the arm 170 such that the notch 182 is open at the top and on the rear end. The peg 180 is then pivotally secured in the quarter-circular section of the notch 182 by a chain 184 or other suitable means, such that the peg 180 remains in place for changes in draft in the tugboat 14.

In the preferred embodiment, the tugboat 14 may further include a fender 186 comprised of rubber or other suitable material around the front half of the tugboat at the level of the hull to which the linkage 20 mates to absorb the impact between tug 14 and the linkage 20. Similarly, a bumper 188 of like material may be included on the arm 170 positioned at expected points of frictional engagement between the tug 14 and linkage 20. It should be understood that similar fenders may be used in the other embodiments to absorb impact between the members and minimize wear and damage.

The instant invention has been disclosed in connection with specific embodiments. However, it will be apparent to those skilled in the art that variations from the illustrated embodiments may be undertaken without departing from the spirit and scope of the invention. For example, the mating surfaces secured to the tugboat could have an arcuate configuration rather than the inner opposing surfaces secured to the linkage frame. Additionally, compression surfaces for receiving forward propulsion by the tugboat on the barge may be included in each of the embodiments on the linkage frame. Also, the linkages could be pivotally secured to the tugboats with suitable uniform means for selectively securing and detaching the linkages for pivotal movement for a variety of different barges such that a single tugboat and linkage could be adaptable to many different barge applications. These and other variations will be apparent to those skilled in the art and are within the spirit and scope of the invention.

What I claim is:

1. An apparatus for coupling first and second vessels, the apparatus minimizing roll of one vessel relative to the other while permitting freedom of movement for pitching and heaving of one vessel relative to the other, comprising:

a linkage frame pivotally secured to one end of the first vessel along a substantially horizontal axis, the linkage frame defining a recess generally facing the second vessel and comprising elongated, inner opposing surfaces;

mating means for aligning one end of the second vessel between the inner opposing surfaces of the linkage frame such that the mating means and the inner opposing surfaces engage to minimize roll of the second vessel relatively to the first vessel; and means for securing the second vessel to the linkage frame such that freedom of movement of the second vessel relatively to the first vessel for pitching and heaving is permitted.

2. The apparatus of claim 1 wherein said mating means comprise outwardly-facing mating surfaces secured to opposite sides of the second vessel.

3. The apparatus of claim 1, wherein the linkage frame comprises a unitary body having an elongated vertical slot generally facing the second vessel, the slot defining said elongated, inner opposing surfaces; and wherein said mating means comprises an elongated protrusion comprising opposing elongated aligning surfaces, said surfaces having a configuration such that the protrusion corresponds to and fits closely within the inner opposing surfaces in order to minimize roll of the second vessel relatively to the first vessel.

4. The apparatus of claim 3 further comprising:

a first arm secured to the linkage frame and extending along one side of the second vessel when the second vessel is aligned in place; and a second arm secured to the linkage frame and extending along the opposite side of the second vessel;

wherein the means for securing the second vessel to the linkage frame comprises means for pivotally securing the first and second arms to the second vessel at substantially opposite points along the length of the second vessel such that pitching and heaving of the second vessel relative to the first vessel is permitted.

5. The apparatus of claim 3 wherein the inner opposing surfaces, the protrusion and the bottom of the slot have concentric arcuate configurations, concave toward the second vessel, such that said protrusion remains within said slot upon pitching and heaving of the second vessel relatively to the first vessel and such that clearance between the second vessel and the linkage frame remains substantially constant upon the pitching and heaving of the second vessel.

6. The apparatus of claim 4 wherein the means for pivotally securing the first and second arms to the second vessel comprises:

a first universal joint secured to the first arm having a hollow bore of selected diameter;

a second universal joint secured to the second arm having a hollow bore of selected diameter;

a first hydraulic cylinder secured to one side of the second vessel and including a first extendable rod of outer diameter less than the diameter of the hollow bore of the first universal joint; and a second hydraulic cylinder secured to the opposing side of the second vessel and including a second extendable rod of outer diameter less than the diameter of the hollow bore of the second universal joint;

wherein the first and second universal joints and the first and second hydraulic cylinders are positioned such that upon alignment of the protrusion within the slot, the first hydraulic cylinder rod may extend through the bore of the first universal joint and the second hydraulic cylinder rod may extend through the second universal joint in order to pivotally secure the first and second arms to the second vessel at substantially opposing points.

7. The apparatus of claim 4 wherein the first and second arms are pivotally secured to the linkage frame on opposing sides of the second vessel, each along a substantially vertical axis, wherein the means for pivotally securing the first and second arms to the second vessel comprises:

a first universal joint secured to the first arm, the first universal joint including a casing and a spherical sleeve mounted in the casing;

a cantilever mounted in the sleeve comprising a first stem extending therefrom;

a second universal joint secured to the second arm, the second universal joint including a casing and spherical sleeve mounted in the casing;

a cantilever mounted in the sleeve comprising a second stem extending therefrom;

a first hydraulic cylinder secured to one side of the second vessel comprising a coupling securable to said first stem; and a second hydraulic cylinder secured to the opposing side of the second vessel comprising a coupling securable to said second stem, wherein said universal joints and said couplings are positioned such that upon alignment of the protrusion within the slot, the couplings are adapted to pivotally secure the first and second arms to the second vessel at substantially opposing points.

8. The apparatus of claim 1 wherein the first vessel has a large recess in said one end to receive a major portion of the end of the second vessel and wherein the linkage frame comprises:

a first arm pivotally secured along a substantially horizontal axis to said one end of the first vessel on one side of the recess, said first arm comprising an elongated inner opposing surface and a second arm pivotally secured along a substantially horizontal axis, to said one end of the first vessel on the opposing side of the recess, said second arm comprising an elongated, inner opposing surface.

9. The apparatus of claim 8 wherein the mating means comprise:

outwardly facing mating surfaces secured to opposite sides of the second vessel such that the aligning surfaces closely align the second vessel between the inner opposing surfaces in order to minimize roll of the second vessel relative to the first vessel.

10. The apparatus of claim 9 wherein the means for securing the second vessel to the linkage frame comprises means for pivotally securing the first and second arms to the second vessel at substantially opposite points along the length of the second vessel such that pitching and heaving of the second vessel relative to the first vessel is permitted.

11. The apparatus of claim 9, further comprising:

a first elongated bearing surface secured to the linkage frame generally facing the second vessel and an opposing bearing surface secured to the second vessel facing the first bearing surface in order to provide a compression surface for propulsion of the first vessel by pushing by the second vessel.

12. The apparatus of claim 10, further comprising:

a first elongated bearing surface secured to the linkage frame generally facing the second vessel and an opposing bearing surface secured to the second vessel facing the first bearing surface such that the two bearing surfaces contact in order to prevent contact of the end of the second vessel with the inside of the large recess during heaving and pitching of the second vessel relative to the first vessel and in order to provide a compression surface for propulsion of the first vessel by pushing by the second vessel.

13. The apparatus of claim 11 wherein said first elongated bearing surface has an arcuate configuration, the arc having a radius sufficient to permit pitching and heaving of the second vessel relative to the first vessel.

14. The apparatus of claim 12 wherein said first elongated bearing surface has an arcuate configuration, the arc having a radius sufficient to permit pitching and heaving of the second vessel relative to the first vessel.

15. The apparatus of claim 10 or 13 wherein the means for pivotally securing the first and second arms to the second vessel comprises:

a first universal joint secured to the first arm having a hollow bore of selected diameter;

a second universal joint secured to the second arm having a hollow bore of selected diameter;

a first hydraulic cylinder including a first extendable rod of outer diameter less than the diameter of the hollow bore of the first universal joint; and a second hydraulic cylinder including a second extendable rod of outer diameter less than the diameter of the hollow bore of the second universal joint;

wherein the first and second universal joints and and the first and second hydraulic cylinders are positioned such that upon alignment of the second vessel within the first and second inner opposing surfaces, the first hydraulic cylinder rod may extend through the bore of the first universal joint and the second hydraulic cylinder rod may extend through the second universal joint in order to pivotally secure the first and second arms to the second vessel at substantially opposing points.

16. The apparatus of claims 10 or 9 wherein the means for pivotally securing the first and second arms to the second vessel comprises:

a first extension pivotally secured to the first arm along a substantially vertical axis;

a second extension pivotally secured to the second arm along a substantially vertical axis;

a first universal joint secured to the first extension, the first universal joint including a casing and a spherical sleeve mounted in the casing;

a cantilever mounted in the sleeve comprising a first stem extending therefrom;

a second universal joint secured to the second extension, the second universal joint including a casing and a spherical sleeve mounted in the casing;

a centilever mounted in the sleeve comprising a second stem extending therefrom;

a first hydraulic cylinder comprising a coupling securable to said first stem; and a second hydraulic cylinder comprising a coupling securable to said second stem, wherein said universal joints and said couplings are positioned such that upon alignment of the second vessel within the first and second inner opposing surfaces, the couplings are adapted to pivotally secure the first and second extensions to the second vessel at substantially opposing points.

17. An apparatus for coupling a non-propelled barge to a tugboat, the apparatus minimizing roll of the tugboat relative to the barge while permitting freedom of movement for pitching and heaving of the tugboat relative to the barge comprising:

a linkage frame pivotally secured to the stern of the barge along a substantially horizontal axis, the linkage frame defining a recession generally facing the tugboat and comprising elongated, inner opposing surfaces, mating means for aligning the bow of the tugboat between the inner opposing surfaces of the linkage frame such that the mating means and the inner opposing surfaces engage to minimize roll of the tugboat relatively to the barge; and means for securing the tugboat to the linkage frame such that freedom of movement of the tugboat relative to the barge for pitching and heaving is permitted.

18. The apparatus of claim 17 wherein said mating means comprise outwardly facing mating surfaces secured to opposite sides of the tugboat.

19. The apparatus of claim 17 wherein the linkage frame comprises a unitary body having an elongated vertical slot generally facing the tugboat, the slot comprising said elongated, inner opposing surfaces; and wherein said mating means comprises an elongated protrusion extending forwardly from the bow of the tugboat, said protrusion comprising opposing elongated aligning surfaces having a configuration such that the protrusion corresponds to and fits closely within the inner opposing surfaces in order to minimize roll of the tugboat relative to the barge when the tugboat is connected to the linkage frame.

20. The apparatus of claim 19 further comprising:

a first arm secured to the linkage frame and extending along one side of the tugboat when the tugboat is aligned in place; and a second arm secured to the linkage frame extending rearwardly from the barge along the opposite side of the tugboat;

wherein the means for securing the tugboat to the linkage frame comprises means for pivotally securing the first and second arms to the tugboat at substantially opposite points along the length of the tugboat such that pitching and heaving of the tugboat relative to the barge is permitted.

21. The apparatus of claim 19 wherein the inner opposing surfaces, the protrusion and the slot are configured each to have a concentric arcuate configuration, concave toward the tugboat, when the tugboat is connected to the linkage frame such that the protrusion remains within said slot upon pitching and heaving of the tugboat relative to the barge.

22. The apparatus of claims 20 or 21 wherein the means for pivotally securing the first and second arms to the tugboat comprises:

a first universal joint secured to the first arm having a hollow bore of selected diameter;

a second universal joint secured to the second arm having a hollow bore of selected diameter;

a first hydraulic cylinder secured to one side of the tugboat and including a first extendable rod of outer diameter less than the diameter of the hollow bore of the first universal joint; and a second hydraulic cylinder secured to the opposing side of the tugboat and including a second extendable rod of outer diameter less than the diameter of the hollow bore of the second universal joint;

wherein the first and second universal joints and and the first and second hydraulic cylinders are positioned such that upon alignment of the protrusion within the slot, the first hydraulic cylinder rod may extend through the bore of the first universal joint and the second hydraulic cylinder rod may extend through the second universal joint in order to pivotally secure the first and second arms to the tugboat at substantially opposing points.

23. The apparatus of claims 20 or 23 wherein the first and second arms are pivotally secured to the linkage frame on their respective sides, each along a substantially vertical axis and wherein the means for pivotally securing the first and second arms to the tugboat comprises:

a first universal joint secured to the first arm, the first universal joint including a casing and a spherical sleeve mounted in the casing;

a cantilever mounted in the sleeve comprising a first stem extending therefrom;

a second universal joint secured to the second arm, the second universal joint including a casing and a spherical sleeve mounted in the casing;

a cantilever mounted in the sleeve comprising a second stem extending therefrom;

a first hydraulic cylinder secured to one side of the tugboat comprising a coupling securable to said first stem; and a second hydraulic cylinder secured to the opposing side of the tugboat comprising a coupling securable to said second stem, wherein said universal joints and said couplings are positioned such that upon alignment of the protrusion within the slot, the couplings are adapted to pivotally secure the first and second arms to the tugboat at substantially opposing points.

24. The apparatus of claim 19 wherein said protrusion comprises a substantially slab-sided stem having a width slightly less than the width of said slot and having a length such that the stem remains within the slot upon pitching and heaving of the tugboat relatively to the barge.

25. The apparatus of claim 17 wherein the barge has a large recess in the stern to receive a major portion of bow of the tugboat and wherein the linkage frame comprises:

a first arm pivotally secured along a substantially horizontal axis to the stern of the barge on one side of the recess, said first arm comprising an elongated inner opposing surface; and a second arm pivotally secured along a substantially horizontal axis, to the stern of the barge on the opposing side of the recess, said second arm comprising an elongated, inner opposing surface.

26. The apparatus of claim 25 wherein the mating means comprise:

first and second elongated, aligning surfaces secured to opposite sides of the tugboat such that the aligning surfaces closely align the bow of the tugboat between the inner opposing surfaces in order to minimize roll of the tugboat relatively to the barge.

27. The apparatus of claim 26 wherein the means for securing the tugboat to the linkage frame comprises means for pivotally securing the first and second arms to the tugboat at substantially opposite points along the length of the tugboat such that pitching and heaving of the tugboat relative to the barge is permitted.

28. The apparatus of claim 26, further comprising:

a first elongated bearing surface secured to the linkage frame generally facing the second vessel and an opposing bearing surface secured to the tugboat facing the first bearing surface such that the two bearing surfaces contact in order to provide a compression surface for propulsion of the barge by pushing by the tugboat.

29. The apparatus of claim 27, further comprising:

a first elongated bearing surface secured to the linkage frame generally facing the tugboat, and an opposing bearing surface secured to the tugboat facing the first bearing surface such that the two bearing surfaces contact in order to provide a compression surface for propulsion of the barge by pushing by the tugboat.

30. The apparatus of claim 29 wherein said first elongated bearing surface has an arcuate configuration, the arc having a radius sufficient to permit pitching and heaving of the tugboat.

31. The apparatus of claim 28 wherein said first elongated bearing surface has an arcuate configuration, the arc having a radius sufficient to permit pitching and heaving of the tugboat.

32. The apparatus of claims 27 or 30 wherein the means for pivotally securing the first and second arms to the tugboat comprises:

a first universal joint secured to the first arm having a hollow bore of selected diameter;

a second universal joint secured to the second arm having a hollow bore of selected diameter;

a first hydraulic cylinder secured to one side of the tugboat including a first extendable rod of outer diameter less than the diameter of the hollow bore of the first universal joint; and a second hydraulic cylinder secured to the opposite side of the tugboat including a second extendable rod of outer diameter less than the diameter of the hollow bore of the second universal joint;

wherein the first and second universal joints and the first and second hydraulic cylinders are positioned such that upon alignment of the tugboat within the inner opposing surfaces, the first hydraulic cylinder rod may extend through the bore of the first universal joint and the second hydraulic cylinder rod may extend through the second universal joint in order to pivotally secure the first and second arms to the tugboat at substantially opposing points.

33. The apparatus of claims 29 or 30 and wherein the means for pivotally securing the first and second arms to the second vessel comprises:

a first extension pivotally secured to the first arm along a substantially vertical axis;

a second extension pivotally secured to the second arm along a substantially vertical axis;

a first universal joint secured to the first extension, the first universal joint including a casing and a spherical sleeve mounted in the casing;

a cantilever mounted in the sleeve comprising a first stem extending therefrom;

a second universal joint secured to the second extension, the second universal joint including a casing and a spherical sleeve mounted in the casing;

a cantilever mounted in the sleeve comprising a second stem extending therefrom;

a first hydraulic cylinder secured to one side of the tugboat comprising a coupling securably to said first stem; and a second hydraulic cylinder secured to the opposing side of the tugboat comprising a coupling securable to said second stem, wherein said universal joints and said couplings are positioned such that upon alignment of the tugboat between the inner opposing surfaces, the couplings are adapted to pivotally secure the first and second extensions to the tugboat at substantially opposing points.

34. The apparatus of claims 1 or 2 wherein said means for securing the second vessel comprises a matching slot and key member securing the second vessel on each side to the linkage frame such that the key members move within the slots to permit vertical heaving of the second vessel relatively to the first vessel while restricting for and aft movement of the second vessel relative to the first vessel and wherein either the slot or key member is mounted to permit relative pitching of the second vessel to the first vessel.

35. The apparatus of claim 34 wherein said key members comprise opposing arms slidably secured to the first vessel for inward linear movement transverse to the first vessel, said arms positioned on either side of the second vessel when such a second vessel is aligned in place, further comprising:

first and second elongated bearing surfaces secured to the first arm, the first bearing surface facing generally rearward and the second bearing surface facing generally forward;

third and fourth elongated bearing surfaces secured to the second arm, the third bearing surface facing generally rearward and the fourth bearing surface facing generally forward;

a hydraulic cylinder secured to the first vessel for moving said first arm toward the centerline of the first vessel;

fifth and sixth opposing bearing surfaces secured to the second vessel, said fifth and sixth surfaces being positioned such that said first and second bearing surfaces snuggly fit within said fifth and sixth surfaces upon linear movement of the first arm toward the centerline of the first vessel when such a second vessel is aligned in place; and seventh and eighth opposing bearing surfaces secured to the opposite side of the second vessel from the fifth and sixth bearing surfaces, said seventh and eighth bearing surfaces, being positioned such that said third and fourth bearing surfaces snuggly fit within said seventh and eighth surfaces upon linear movement of the first arm toward the centerline of the first vessel when such a second vessel is in place.

36. The apparatus of claim 35 wherein said first and second elongated bearing surfaces and said third and fourth elongated bearing surfaces respectively have a concentric, arcuate configuration convex to the first vessel.

37. The apparatus of claim 2 wherein the linkage frame further comprises yaw-resisting surfaces mounted to the linkage frame and positioned rearward on the linkage frame proximate the sides of the tugboat in order to absorb steering moment of the tugboat.

38. The apparatus of claim 18 wherein the linkage frame further comprises yaw-resisting surfaces mounted to the linkage frame and positioned rearward on the linkage frame proximate the sides of the tugboat in order to absorb steering moment of the tugboat.

39. An apparatus for coupling a non-propelled barge to a catamaran tugboat having opposing hulls, the apparatus minimizing roll of the catamaran tugboat relative to the barge while permitting freedom of movement for pitching and heaving of the tugboat relative to the barge comprising:

a linkage frame pivotally secured to the stern of the barge along a substantially horizontal axis, the linkage frame configured in a wedge to fit closely between the hulls of the catamaran tugboat and comprising elongated outwardly facing surfaces;

mating means for aligning the linkage frame between the hulls of the tugboat such that the mating surfaces and the inner opposing surfaces engage to minimize roll of the tugboat relatively to the barge; and means for securing the tugboat to the linkage frame such that freedom of movement of the tugboat relatively to the barge for pitching and heaving is permitted.

40. The apparatus of claim 39 wherein said mating means comprise inwardly facing mating surfaces secured to the opposite inboard sides of the tugboat hulls.

41. The apparatus of claims 46 or 47 wherein said securing means includes a cylinder secured on inboard sides of the tugboat hulls, the cylinders each including a piston movably secured therein such that the piston may be selectively extended inwardly toward the center of the tugboat, wherein the linkage frame has matching receiving bores to receive the extended piston in order to secure the tugboat to the linkage.

42. The apparatus of claim 1 wherein the mating means include said inner opposing surfaces configured to closely fit the outermost outline of a hull of such a second vessel for all relative changes in draft of the two vessels.

43. Apparatus for coupling a second vessel to a first vessel to minimize roll of one vessel relatively to the other while permitting pitching and heaving of the vessels relatively to each other characterized in that the apparatus comprises:

a linkage frame adapted to be pivotally secured to one end of a first vessel for pivotal displacement about a substantially horizontal axis, the linkage frame including a pair of opposed, inner elongated surfaces which are laterally spaced, which are positioned to be directed transversely to the intended direction of motion of such a first vessel, and which are arranged to extend vertically during use; and means for pivotally securing the linkage frame to a second vessel when aligned with the linkage frame for the elongated surfaces to cooperate with complementary surfaces of such a second vessel during use to minimize roll of the second vessel relatively to the first vessel when coupled thereto while permitting pitching and heaving of the vessels relatively to each other.

44. Apparatus according to claim 43, characterized in that the opposed elongated surfaces have concentric arcuate configurations which are concave in a direction towards a second vessel to be secured to the linkage frame, for the opposed, inner elongated surfaces to cooperate with complementary surfaces of such a second vessel to minimize roll during pitching and heaving of such a second vessel relatively to such a first vessel when coupled together by means of the linkage frame.

45. Apparatus according to claims 43 or 44 characterized in that the linkage frame defines a recess to be directed in a direction away from the first vessel, and in that the opposed elongated surfaces are directed inwardly towards each other for cooperating with complementary outwardly directed surfaces of such a second vessel when aligned with and secured to the linkage frame.

46. Apparatus according to claim 45, characterized in that the linkage frame includes first and second arms which are secured to the linkage frame, and in that the means for pivotally securing the linkage frame, to such a second vessel is provided on the arms.

* * * * *